US005920048A

United States Patent [19]

Crippen et al.

[11] Patent Number: 5,920,048

[45] Date of Patent: Jul. 6, 1999

[54] ELECTRICAL SWITCH AND VARIABLE RESISTANCE MODULE FOR VEHICLE BRAKE PEDAL OR ACCELERATOR AND METHOD OF OPERATION

[75] Inventors: Randall M. Crippen, Chicago; Earl J. Genz, Des Plaines; Daniel J. Danek, Berwyn; Mario Orrico, Chicago, all of Ill.

[73] Assignee: Illinois Tool Works Inc., Glenview, Ill.

[21] Appl. No.: 08/603,041

[22] Filed: Feb. 16, 1996

[51] Int. Cl.[6] ..... H01H 3/14; H01C 10/36; H01C 10/50

[52] U.S. Cl. ..... 200/61.89; 200/61.45 R; 338/198; 338/172

[58] Field of Search ..... 200/1–18, 61.88, 200/61.91; 338/153, 172, 198, 200, 173–184, 210, 43–47; 180/65.1, 65.8

[56] References Cited

U.S. PATENT DOCUMENTS

| | | | |
|---|---|---|---|
| 3,899,041 | 8/1975 | Mager | 180/65.8 |
| 4,087,776 | 5/1978 | Donato | 338/198 |
| 4,123,740 | 10/1978 | Palmer et al. | 338/172 X |
| 4,199,037 | 4/1980 | White | 180/65.4 |
| 4,355,293 | 10/1982 | Driscoll | 338/184 |
| 4,728,923 | 3/1988 | Finger | 340/438 |
| 4,827,241 | 5/1989 | Riser et al. | 338/172 |
| 4,928,227 | 5/1990 | Burba et al. | 180/65.3 X |
| 4,983,946 | 1/1991 | Kotaki et al. | 338/198 |
| 5,023,414 | 6/1991 | Mihara et al. | 200/61.91 |
| 5,086,785 | 2/1992 | Gentile et al. | 338/210 X |
| 5,148,883 | 9/1992 | Tanaka et al. | 364/424.026 X |
| 5,166,589 | 11/1992 | Fukino et al. | 318/642 |
| 5,271,269 | 12/1993 | Rilling et al. | 338/98 X |
| 5,287,772 | 2/1994 | Aoki et al. | 477/20 |
| 5,289,890 | 3/1994 | Toyoda et al. | 180/65.8 |
| 5,359,308 | 10/1994 | Sun et al. | 335/216 |
| 5,365,431 | 11/1994 | Minezawa et al. | 364/424.026 |
| 5,389,825 | 2/1995 | Ishikawa et al. | 307/10.1 |
| 5,453,930 | 9/1995 | Imaseki et al. | 364/424.06 |
| 5,525,768 | 6/1996 | Cobb III et al. | 200/61.88 |

*Primary Examiner*—J. R. Scott
*Attorney, Agent, or Firm*—Schwartz & Weinrieb

[57] ABSTRACT

A method and apparatus for actuating an electrical switch and providing a variable electrical resistance usable to sense displacement of a movable member. The apparatus includes a housing for receiving the electrical switch, a variable resistance element, and an actuator with a body member and a transverse cylindrical sleeve. An electrically conductive wiper is coupled to the actuator and contacts the variable resistance element, which varies with pivotal movement of the actuator. The body member is pivotably supported by an aperture of the housing about an axis of the cylindrical sleeve, and a spring member biases the actuator toward an initial position, wherein the actuator is pivotable against the bias of the spring to actuate the electrical switch and to provide the variable resistance by positioning the electrically conductive wiper along the variable resistance element. A guide surface within the housing guides the actuator and the electrically conductive wiper in fixed relation relative to the variable resistance element when the body member is pivoted within the housing. The cylindrical sleeve protrudes through an aperture of the housing, and is coupled to the movable member by a collar with a set screw without having to calibrate the variable resistor or the switch actuation timing.

15 Claims, 2 Drawing Sheets

ELECTRICAL SWITCH AND VARIABLE RESISTANCE MODULE FOR VEHICLE BRAKE PEDAL OR ACCELERATOR AND METHOD OF OPERATION

FIELD OF THE INVENTION

The invention generally relates to a method and apparatus for providing an electrical switch and a variable electrical resistance, and more specifically for providing an electrical switch actuation and variable electrical resistance which is usable to sense the displacement of a movable member and provide input signals to an electrical controller.

BACKGROUND OF THE INVENTION

Position sensors that sense a change in position of a movable member and provide a corresponding input signal to an electrical controller have many applications. The displacement of movable acceleration and brake pedals on electric vehicles for example has in the past been detectable with an electrical resistance that varies in some proportion to the displacement, which corresponds to a predetermined degree of acceleration or braking desired by an operator. The variable resistance, like a potentiometer or other variable device, is generally mechanically linked with the movable member to sense displacement over a predetermined range of motion. To sense the position of an electric vehicle acceleration or brake pedal, it has been suggested to rotate a potentiometer shaft with an arm extending from the pedal and coupled to a lever extending from the potentiometer shaft. Linkage of the position sensor with the movable member however usually requires custom fabrication of an appropriate length arm between the pedal and the potentiometer. In addition, the position sensor initially must be calibrated to provide a specified range of resistance over the detectable range of motion. Calibration of the sensor moreover is a laborious procedure in part dependent upon proper linkage between the pedal and the potentiometer. Linkage and calibration are further complicated by the fact that some electric vehicles have adjustable accelerator and brake pedals to accommodate the physical stature of the vehicle operator, which affects the required linkage between the pedal and the position sensor.

Some applications require actuation of an electrical switch by the movable member somewhere in its range of motion. In the electric vehicle application for example it is sometimes desirable to actuate a switch so as to provide battery power to an electrical system controller upon depression of the accelerator pedal to some degree during its initial range of motion whereafter the position sensor varies the resistance in correspondence with the position of the movable member so as to control acceleration. Other applications require actuation of a switch when the movable member is at the end of its range of motion, or alternatively at some intermediate point in its range of motion. The switch generally requires a separate mechanical linkage to the movable member or to the potentiometer so as to actuate the switch at the appropriate position of the movable member during its range of motion, which complicates installation and increases costs. The linkage of the switch with the potentiometer further complicates the calibration of the position sensor since it is often critical to properly sequence or accurately time the occurrence of switch actuation and variation of resistance. In electric vehicles for instance the switch must be actuated before any variation of resistance beyond some resistance threshold so as to ensure safe operation of the vehicle. Similar operational constraints may be required in other applications.

In view of the discussion above, there exists a demonstrated need for an advancement in the art of actuating an electrical switch and varying electrical resistance usable for sensing displacement of a movable member.

OBJECTS OF THE INVENTION

It is therefore an object of the invention to provide a novel method and apparatus for actuating an electrical switch and varying an electrical resistance that overcomes the problems with the prior art.

It is also an object of the invention to provide a novel method and apparatus for actuating an electrical switch and varying electrical resistance, which is usable for sensing the displacement of a movable member, and that is economical, reliable and relatively easy to install and calibrate.

It is another object of the invention to provide a novel method and apparatus for actuating an electrical switch and providing a variable electrical resistance usable for sensing the rotational displacement of a movable member.

SUMMARY OF THE INVENTION

Accordingly, the invention is drawn to a method and apparatus for actuating an electrical switch and providing a variable electrical resistance usable to sense the displacement of a movable member. The apparatus includes a housing for receiving the electrical switch, a variable resistance element and an actuator with a body member and a transverse cylindrical sleeve. An electrically conductive wiper is coupled to the actuator and is in contact with the variable resistance element, which varies with pivotal movement of the actuator. The body member is pivotably supported by an aperture of the housing about an axis of the cylindrical sleeve, and a spring member biases the actuator toward an initial position wherein the actuator is pivotable against the bias of the spring so as to actuate the electrical switch and to provide the variable resistance by positioning the electrically conductive wiper along the variable resistance element. A guide surface, which may include raised ribs, within the housing in part maintains the actuator and the electrically conductive wiper in fixed position relative to the variable resistance strip when the body member is pivoted within the housing. In one embodiment, the actuator engages the electrical switch when the actuator is disposed in the initial position, and the actuator disengages the electrical switch when the actuator is pivoted away from the initial position and further pivoting of the actuator proportionately varies the resistance. The actuator also includes a resilient member for buffering or isolating the switch from mechanical shock during engagement by the actuator. The cylindrical sleeve partially protrudes through the aperture of the housing, and is coupled to the movable member by a collar with a set screw and the apparatus is mounted with fasteners without having to calibrate the variable resistance or switch actuation timing.

BRIEF DESCRIPTION OF THE DRAWINGS

These and other objects, features and advantages of the present invention will become more fully apparent upon consideration of the following Detailed Description of the Invention with the accompanying drawings, which may be disproportionate for ease of understanding, wherein like structure and steps are referenced by corresponding numerals and indicators throughout the several views, and wherein.

Figure 1:
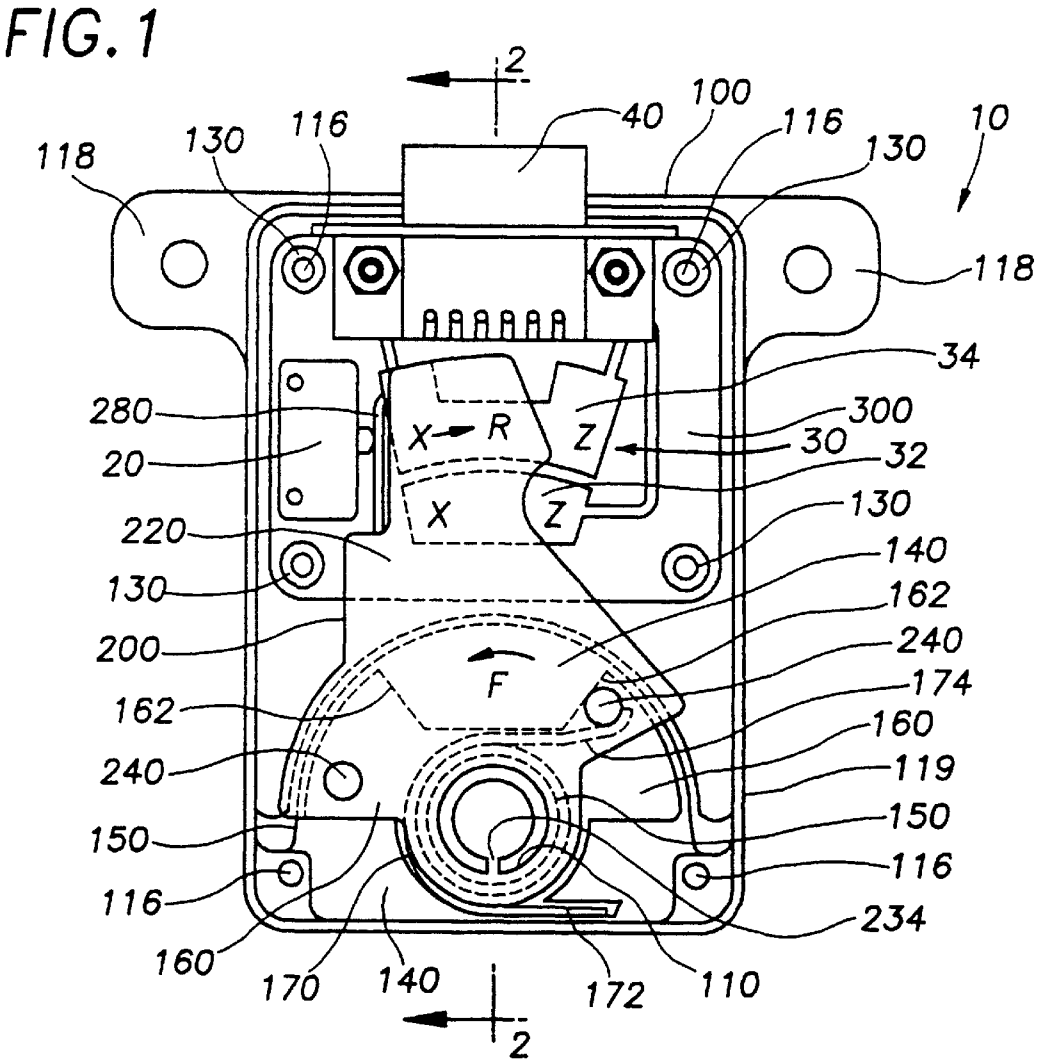
FIG. 1 is a partial side view of an apparatus for actuating an electrical switch and providing a variable electrical resistance according to an exemplary embodiment of the invention.

FIG: 2 is a partial sectional view of the embodiment of FIG. 1 as taken along line 2—2 of FIG. 1.

Figure 3:
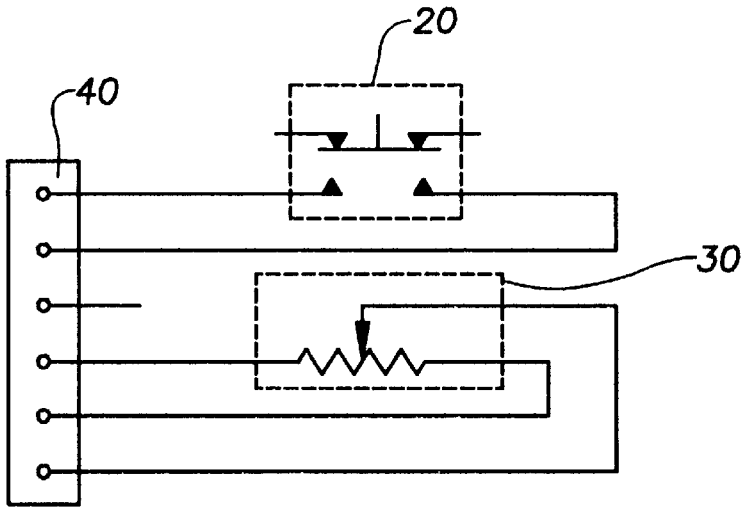

FIG. 3 is a schematic of an electrical circuit according to an exemplary embodiment of the invention.

Figure 4A:
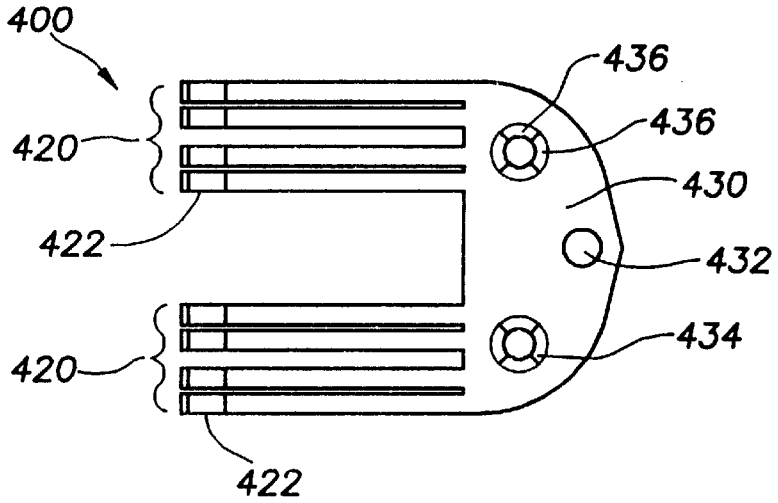

FIG. 4*a* is a top view of an electrically conductive wiper according to an exemplary embodiment of the invention.

Figure 4B:
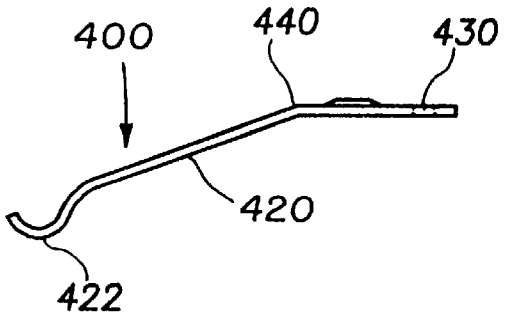

FIG. 4*b* is an enlarged side view of the embodiment of FIG. 4*a*.

DETAILED DESCRIPTION OF THE INVENTION

The invention is discussed in the exemplary context of providing switch status and variable resistance signals to an electrical system controller based on the rotational displacement of a shaft coupled to an accelerator or brake pedal of an electrical vehicle. The method and apparatus however are generally usable for sensing displacement of any movable member connectable to the actuator by a rotatable shaft and for providing switch status and variable resistance input signals to any electrical system. FIG. 1 is a partial side view of an apparatus 10 for actuating an electrical switch and providing a variable electrical resistance according to an exemplary embodiment of the invention. The apparatus generally comprises a housing for receiving the electrical switch 20, a variable electrical resistor 30 and an actuator 200 pivotably disposed in the housing for actuating the switch 20 and varying the resistance as discussed below.

Figure 2:
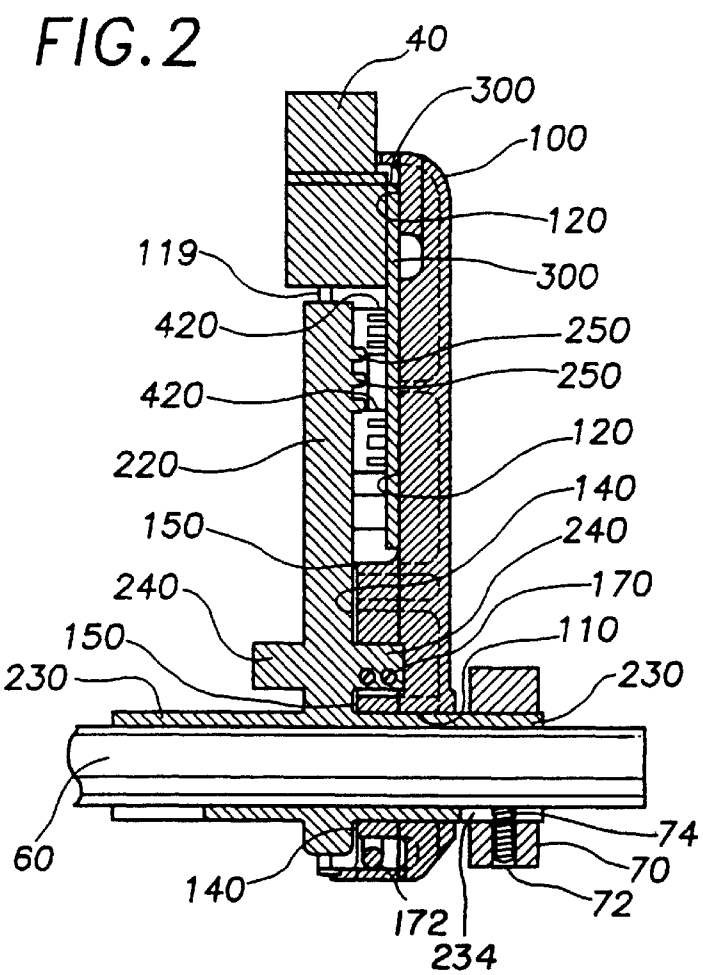

FIGS. 1 and 2 show the housing comprising two substantially similar matable housing portions 100, only one of which is shown in the drawings. The housing includes an aperture 110 for pivotably supporting the actuator 200 therein. The aperture 110 extends through at least one side of the housing. In one embodiment, the aperture 110 extends through two opposite sides of the housing, and in another embodiment the aperture 110 extends through only one side of the housing and the opposite side of the housing includes a bore for pivotably supporting the actuator 200. The housing also includes a mounting surface 120 on which is mountable a printed circuit board 300. A plurality of support members 130 are disposable through apertures in the circuit board for positioning the circuit board 300 in the housing. A collar not shown in the drawing is disposable over the support members 130 to retain the board 300 on its mount upon mating together the housing portions, which are retained together by fastening members like screws or rivets disposed through holes 116 in the housing. At least one housing portion includes mounting flanges 118 with holes for mounting the apparatus to a mounting structure not shown in the drawing, and for additional strength both housing portions may include matable or overlapping flange portions. The housing portions may also include overlapping circumferential edge portions 119 to prevent moisture and particulate matter from entering the housing, which may degrade the electrical components. The matable housing portions preferably are unitary plastic members, which reduce cost and weight, but may be fabricated from metals or composite materials.

The actuator 200 includes a body member 220 and a transverse cylindrical sleeve 230 extending from at least one side of the actuator 200 and protruding through the aperture 110 of the housing. In another embodiment, the cylindrical sleeve 230 extends from opposite sides of the actuator 200 and protrudes through corresponding apertures on opposing sides of the housing, and in another embodiment the cylindrical sleeve 230 protrudes through only one side of the housing and a cylindrical sleeve portion on an opposite side of the actuator 200 is supported in a bore in the housing. The aperture 110, which is a bore through the housing, supports the transverse cylindrical sleeve 230, and a guiding surface 140 on the interior of the housing portion supports opposite side surfaces of the body member 220, which permits the body member 220 to pivot about an axis of the cylindrical sleeve 230 in a substantially fixed path relative to the resistive element on the circuit board 300 discussed below. In one embodiment, the guiding surface 140 has arcuate shaped raised ribs 150 to reduce friction between the body member 220 and the housing. In another embodiment, a film of friction reducing material is disposed between the body member 220 and the housing. The actuator 200 also includes a stud 240 transversely protruding from the body member 220 and extending into a corresponding recess 160 in the housing, which permits unobstructed pivoting movement of the actuator 200 over a specified angular interval. A side wall 162 of the recess 160 engages the stud 240 to limit the pivotal movement of the actuator 200 in the housing. The exemplary embodiment illustrates studs 240 extending from both sides of the actuator 200 and into corresponding recesses 160 in each housing portion 100, but movement of the actuator 200 may alternatively be limited to the specified angular interval by a single stud 240 protruding from one side of the actuator 200 and into a single recess 160 with substantially opposite side walls for engaging the stud 240. The actuator 200 pivots approximately 20 degrees from an initial position in the exemplary embodiment, but the recess 160 may be sized with appropriately spaced side walls to permit more or less pivotal movement. The actuator 200 is biased toward the initial position, which may be toward either side of the housing, by a spring member. In the exemplary embodiment, a torsional spring 170 with a first arm 172 seated in the recess 160 and a second arm 174 engaged about one of the studs 240 biases the actuator 200 in the direction of arrow F toward an initial position wherein the stud 240 is in engagement with the side wall 162. In the exemplary embodiment, the actuator 200 is biased toward and into engagement with the switch 20. The actuator 200 may also include a resilient member 280 to buffer the switch 20 from impact shock when the actuator 200 engages the switch 20, which occurs in the exemplary embodiment when the actuator 200 is returned to the initial position by the spring member 170. The actuator preferably is a unitary plastic member, which reduce costs and weight, but may be fabricated from metals or composite materials.

The electronic circuit board 300, which may be a printed circuit board, has an electrical circuit of the exemplary type shown in FIG. 3 including the electrical switch 20, the variable resistor 30 and an electrical connector 40 for coupling the electrical circuit to an electrical system. In one embodiment, the electrical switch 20 is a snap action switch, which has normally open contacts but alternative switch embodiments may have normally closed contacts. In the exemplary embodiment, the actuator 200 engages the switch 20 when the actuator 200 is biased in the initial position by the spring member 170, and the actuator 200 disengages the switch 20 when the actuator 200 is pivoted against the bias of the spring 170 away from the initial position through an angular displacement of approximately 2 degrees in the direction of arrow R. Actuation of the switch 20 is usable to provide electrical power from a battery to an electronic system controller in the exemplary electric vehicle application based on the initial movement of a foot pedal. The switch 20 may alternatively be located on the opposite side of the board 300 for engagement by the actuator 200 as the actuator 200 is moved farthest away from the initial position wherein the actuator actuates 200 a switch 20 at the end position of its pivotal travel. The switch may alternatively be located upon opposite sides of the circuit board 300 for actuation at the initial and end positions, respectively, and the switch 20 may be positioned for engagement by the actuator 200 at some intermediate point in the pivotal interval of the actuator 200.

The variable resistor 30 includes a constant resistance element 32 and a variable resistance element 34, which are preferably deposited or fabricated in a plane dimension on the circuit board 300 to facilitate contact by an electrically conductive wiper coupled to the pivotable actuator 200 discussed below. The constant resistance element 32 is a polymer thickfilm covered conductive ink composition, but may alternatively be a metallic trace like copper, on the printed circuit board 300. The variable resistance element 34 also is a polymer thickfilm covered conductive ink composition, and may alternatively be some other resistance element, that varies over a spatial dimension. In the exemplary embodiment, the resistance increases in the direction of arrow R and varies substantially linearly with distance between some nominal value and approximately 5 K ohms. The resistance however may generally have a nonlinear variation, which increases or decreases between other resistive values.

FIG. 4 is an electrically conductive wiper 400 that is coupled to the actuator 200 and electrically connects the constant resistance element 32 to the variable resistance element 34. The wiper provides a variable resistance as the wiper is moved across the variable resistance element 34 by the pivotable actuator 200. The wiper 400 includes at least two resilient arms 420 each of which contacts one of the resistance elements 32 and 34 to form an electrical contact therebetween. An end portion of each arm 420 has an arcuate shaped surface 422 that is in slidable contact with the corresponding resistive element 32, 34. In the exemplary embodiment, each wiper arm 420 is divided into a plurality of substantially parallel arms 420 in contact with corresponding resistive elements 32, 34. The parallel arms 420 provide a degree of redundancy and reduce noise. The wiper 400 also has a mounting surface 430 for mounting onto the body member 220 of the actuator 200, and the arms 420 are configured to extend away from the actuator 200 and toward the resistive elements 32, 34 by bending the arms 420 at some point 440 proximate the mounting surface 430 of the wiper. The resilient arms 420 extended away from the actuator 200 and are biased into electrically conducting contact with the resistive elements 32, 34 when the wiper 400 is mounted onto the actuator 200. The wiper 400 contacts the resistive elements 32, 34 at the contact points x in FIG. 1 when the actuator 200 is in the initial position. The mounting surface 430 includes holes 432, which may include radial slits 434 to form resilient tabs 436 to engage a corresponding stud 250 extending from the body member 220, which retain the wiper 400 on the actuator 200.

FIG. 2 illustrates a pivotably displacable shaft 60 coupled to the actuator 200. The shaft 60 has dimensions that permit disposal of the shaft 60 into a bore of the cylindrical sleeve 230. A collar 70 is slidably disposable over the cylindrical sleeve portion 230 protruding from the housing and includes a threaded bore 72 for receiving a set screw 74. The cylindrical sleeve 230 includes a gap or opening 234, most clearly illustrated in FIG. 1, through which the set screw 74 is advanced to engage and clamp the shaft 60 to the cylindrical sleeve 230. A second collar may be applied to a second portion of the cylindrical sleeve 230 in embodiments where the cylindrical sleeve 230 protrudes through both sides of the housing. The pivotable shaft 60 is generally coupled to the movable member, not shown in the drawing, which pivots or drives the actuator 200. In the exemplary electric vehicle application, the shaft 60 is coupled to an accelerator or brake pedal, and the shaft 60 pivots in some proportion to the movement of the pedal. Installation of the apparatus is relatively simple and requires no adjustment of the components internal of the housing to calibrate the resistance or timing of switch actuation and variation of resistance. After the foot pedals on the electrical vehicle have been adjusted to accommodate the designated operator, the shaft 60 extending from the pedal is inserted into the cylindrical sleeve 230 and the apparatus is mounted onto the vehicle. The set screw 74 is then advanced to clamp the shaft 60 onto the cylindrical sleeve 230 and the installation is complete. The timing of the actuation of the switch 20 and the variation of the resistance 30 are not effected by the relative angular positions of the shaft 60 and the cylindrical sleeve 230.

In one mode of operation, the actuator 200 is moved away from the initial position in the direction of arrow R toward the end position wherein the resistance is varied substantially linearly from some nominal value to approximately 5 K Ohms as the wiper contact point moves from the x position across the resistive elements 32, 34 toward the z position. This arrangement is usable to control the speed of an electric motor for acceleration or regenerative braking based on movement of a foot pedal in the exemplary application. In one application, the resistance varies between the nominal value and approximately 500 Ohms as the actuator 200 is initially pivoted from the initial position at 0 degrees in the direction of arrow R approximately 2 degrees. The actuator 200 disengages the switch 20 within the two degree pivotal range to provide power to the controller as discussed above. At the 2 degree position, the resistance is desired to be approximately 500 Ohms. Further pivoting of the actuator 200 linearly increases the resistance to a maximum of approximately 5 K Ohms, which is usable by the system controller to vary electric motor speed for acceleration or regenerative braking.

While the foregoing written description of the invention enables anyone skilled in the art to make and use what is at present considered to be the best mode of the invention, it will be appreciated and understood by those skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. Apparatus for actuating an electrical switch and providing a variable electrical resistance useable to sense displacement of a movable member, comprising:

a housing;

an electrical switch disposed within said housing;

an actuator, comprising a body member, and a cylindrical sleeve member defining a pivot axis within said housing, such that said body member of said actuator is pivotably mounted with respect to said housing and about said axis of said cylindrical sleeve member;

a spring member for biasing said actuator toward an initial position at which said body member of said actuator engages said electrical switch and for permitting pivotable movement of said body member away from said electrical switch and against the biasing force of said spring member in response to movement of said actuator by a movable member whose displacement is to be sensed;

a variable electrical resistor disposed within said housing; and an electrically conductive wiper mounted upon said body member of said actuator and disposed in contact with said variable electrical resistor disposed within said housing such that when said body member of said actuator is pivoted away from said electrical switch and against said biasing force of said spring member, displacement of said movable member, as a function of variable electrical resistance developed as a result of the disposition of said electrically conductive wiper along said variable electrical resistor, can be sensed.

2. The apparatus of claim 1 wherein the housing includes an aperture for pivotably supporting the cylindrical sleeve member of the actuator, and a guide surface disposed within the housing for guiding the body member and the electrically conductive wiper relative to the variable resistance element when the body member is pivoted within the housing.

3. The apparatus of claim 2 wherein the guide surface includes a raised rib disposed on at least one side of the body member wherein the raised rib is engagable with the body member when the body member is pivoted within the housing.

4. The apparatus of claim 1 wherein the body member includes a resilient member for engaging the electrical switch and for buffering the electrical switch from mechanical shock when the body member engages the electrical switch.

5. The apparatus of claim 1, wherein:

said variable electrical resistor comprises a variable resistance element and a constant resistance element; and said electrically conductive wiper comprises a first set of electrically conductive prongs disposed in contact with said variable resistance element and a second set of electrically conductive prongs disposed in contact with said constant resistance element so as to define an electrical connection between said variable resistance element and said constant resistance element.

6. The apparatus as set forth in claim 5, wherein:

said variable resistance element and said constant resistance element both comprise conductive ink compositions.

7. The apparatus of claim 1, wherein:

at least one end portion of said cylindrical sleeve member protrudes through an aperture defined within said housing;

a shaft portion, adapted to be connected to said movable member whose displacement is to be sensed, disposed within said cylindrical sleeve member;

an aperture defined within said at least one end portion of said cylindrical sleeve member;

a collar disposed about said at least one end portion of said cylindrical sleeve member which protrudes from said housing; and a set screw mounted upon said collar and disposed within said aperture defined within said at least one end portion of said cylindrical sleeve member for engaging said shaft portion so as to fixedly retain said movable member with respect to said cylindrical sleeve member.

8. The apparatus as set forth in claim 1, wherein:

a recess is defined within said housing;

stud means are provided upon said actuator; and said spring member comprises a torsional spring having a first end portion thereof disposed within said recess defined within said housing, and a second end portion thereof operatively engaged with said stud means of said actuator for biasing said actuator toward said initial position.

9. A method of actuating an electrical switch and providing a variable electrical resistance useable to sense the displacement of a movable member, comprising the steps of:

providing a housing;

disposing an electrical switch within said housing;

pivotably mounting an actuator, comprising a body member, and a cylindrical sleeve member defining a pivot axis, within said housing such that said body member is pivotable with respect to said housing and about said axis of said cylindrical sleeve member;

disposing a variable electrical resistor within said housing;

biasing said actuator toward an initial position at which said body member of said actuator engages said electrical switch and yet permitting said body member to be pivotably moved away from said electrical switch in response to movement of said actuator by a movable member whose displacement is to be sensed; and mounting an electrically conductive wiper upon said body member of said actuator so as to be disposed in contact with said variable electrical resistor disposed within said housing such that when said body member of said actuator is pivoted about said axis of said cylindrical sleeve member and away from said electrical switch, displacement of said movable member, as a function of variable electrical resistance developed as a result of the disposition of said electrically conductive wiper along said variable electrical resistor, can be sensed.

10. The method of claim 9 further comprising the step of coupling said movable member to the cylindrical sleeve member so as to pivot the actuator in the housing.

11. The method as set forth in claim 10, wherein said coupling of said movable member to said cylindrical sleeve member comprises the steps of:

positioning said cylindrical sleeve member within said housing such that at least one end portion of said cylindrical sleeve member protrudes outwardly from said housing;

providing said at least one end of said cylindrical sleeve member, which protrudes from said housing, with an aperture;

inserting a shaft portion, adapted to be connected to said movable member whose displacement is to be sensed, within said cylindrical sleeve member;

mounting a collar upon said at least one end portion of said cylindrical sleeve member which protrudes outwardly from said housing;

threadedly engaging a set screw within said collar so as to pass through said aperture, defined within said at least one end portion of said cylindrical sleeve member, so as to engage said shaft portion thereby fixedly retaining said movable member with respect to said cylindrical sleeve member.

12. The method as set forth in claim 9, further comprising the steps of:

forming said variable electrical resistor so as to comprise a variable resistance element and a constant resistance element; and forming said electrically conductive wiper so as to comprise first and second sets of electrically conductive prongs for respective electrical connection with said variable resistance element and said constant resistance element.

13. The method as set forth in claim 12, further comprising the step of:

fabricating said variable resistance element and said constant resistance element from conductive ink compositions.

14. The method as set forth in claim 9, wherein:

said step of biasing said actuator is achieved by a torsional spring.

15. The method as set forth in claim 14, further comprising the steps of:

providing said housing with a recess;

providing said actuator with at least one stud; and engaging one end of said torsional spring within said recess of said housing, and engaging a second end of said torsional spring with said at least one stud of said actuator.

* * * * *